US006859544B2

(12) United States Patent
Kato et al.

(10) Patent No.: US 6,859,544 B2
(45) Date of Patent: Feb. 22, 2005

(54) MAGNETIC CIRCUIT FOR SPEAKER, METHOD OF MANUFACTURE THEREOF, AND SPEAKER USING SAME

(75) Inventors: Kazuma Kato, Tamaho-machi (JP); Toshifumi Fukawatase, Tamaho-machi (JP)

(73) Assignee: Minebea Co., Ltd., Nagano-Ken (JP)

( * ) Notice: Subject to any disclaimer, the term of this patent is extended or adjusted under 35 U.S.C. 154(b) by 126 days.

(21) Appl. No.: 10/425,935

(22) Filed: Apr. 30, 2003

(65) Prior Publication Data

US 2004/0086146 A1 May 6, 2004

(30) Foreign Application Priority Data

Oct. 30, 2002 (JP) ..... 2002-315311

(51) Int. Cl.[7] ..... H04R 25/00
(52) U.S. Cl. ..... 381/412; 381/408; 381/431
(58) Field of Search ..... 381/398, 408, 381/410, 412, 414, 421, 422, 431; 29/594, 609.1; 335/222, 302

(56) References Cited

U.S. PATENT DOCUMENTS 4,544,805 A * 10/1985 Sawafuji ..... 381/410
5,214,404 A * 5/1993 Yamaguchi et al. ..... 335/302
5,687,248 A 11/1997 Yen et al.

FOREIGN PATENT DOCUMENTS

EP 0 685 983 A2 A3 12/1995
JP 63-99700 4/1988

* cited by examiner

*Primary Examiner*—Huyen D. Le
(74) *Attorney, Agent, or Firm*—McDermott Will & Emery LLP

(57) ABSTRACT

A magnetic circuit for a speaker comprises: a bonded magnet shaped rectangular in top plan view, having on its top face a plurality of grooves formed to extend all the way along two opposing sides thereof and arrayed in parallel with one another at predetermined intervals, and magnetized such that magnetic fluxes at two adjacent grooves are directed inversely to each other; and a plurality of plate-like pole pieces fixedly disposed on the top face of the bonded magnet, and arrayed along the grooves such that two adjacent pole pieces form an air gap located along the center of each groove thereby forming a magnetic gap. And, there is provided a speaker which uses the magnetic circuit thereby achieving a reduced profile.

8 Claims, 7 Drawing Sheets

MAGNETIC CIRCUIT FOR SPEAKER, METHOD OF MANUFACTURE THEREOF, AND SPEAKER USING SAME

BACKGROUND OF THE INVENTION

1. Field of the Invention

The present invention relates to a magnetic circuit for a speaker for use in various audio equipments, and more particularly to a magnetic circuit using a sintered magnet, a method of manufacturing the circuit, and a speaker incorporating the magnetic circuit.

2. Description of Related Art

Since speakers used in televisions and radios are usually demanded to be small in size and low in profile, an inner magnet type magnetic circuit is adopted, which comprises a pot yoke, a sintered magnet, and a pole piece. The magnetic circuit using a sintered magnet involves a disadvantage that a pot yoke is required. In order to reduce the profile of the magnetic circuit, the pot yoke, sintered magnet and pole piece must all be lower-profiled. Since the performance of the magnetic circuit is dependent on the thickness of the pot yoke and the pole piece, if the pot yoke and the pole piece have their profiles reduced while the sintered magnet has its thickness kept unchanged, the magnetic circuit is saturated thereby failing to achieve a satisfactory performance, and if a plurality of voice coils are used, the voice coils require respective magnetic circuits.

In this connection, Japanese Patent Application Laid-open No. Sho 63-99700 discloses a magnetic circuit, in which a sintered magnet shaped annular and having anisotropy in the radial direction is integrated with a pot yoke, whereby a speaker can be lower-profiled and the magnet can be more efficient.

The magnetic circuit disclosed in Japanese Patent Application Laid-open No. Sho 63-99700 comprises: a yoke, which has a center pole, a flange extending outward from the bottom of the center pole, a first stepped portion formed on the flange at a prescribed distance from the center pole and protruding in the direction opposite to the center pole, and a second stepped portion formed at the outer circumference of the flange and protruding in the same direction as the center pole; and a sintered magnet, which is shaped annular, has an anisotropy in the radial direction, is disposed on the flange of the yoke, has its inner circumference sintered to be integrated with the outer circumference of the center pole, has an outer circumference with a diameter larger than the diameter of the first stepped portion, and which, in association with the second stepped portion, forms an air gap with a predetermined dimension.

The magnetic circuit above described is effective to some extent in that a pole piece disposed over the sintered magnet can be eliminated thereby achieving a lower-profile speaker, but is not satisfactorily effective because it still requires a yoke which takes up the largest space. Also, the magnetic circuit has its yoke structured extremely peculiar as above described, and the yoke has its flange sintered to be integrated with a sintered magnet, thus the fabrication cost of the magnetic circuit is not reduced.

SUMMARY OF THE INVENTION

Under the above circumstances, the present inventors have been dedicated to working on a magnetic circuit with an innovative structure which eliminates a pot yoke, and have successfully invented a magnetic circuit which comprises only a pole piece and a magnet. The prime object of the present invention is to reduce the profile of the magnetic circuit without changing the thickness of the pole piece and the magnet. This, when the profile of the magnetic circuit remains to be unchanged, allows the magnet volume to be increased for a volume which used to be taken up by the pot yoke eliminated, thereby increasing sound pressure. Also, the present invention aims at enabling one magnet to have a plurality of magnetic fluxes generated at different areas thereof and directed inversely to each other, whereby a plurality of voice coils can be driven by one magnet thereby preventing a decrease in sound pressure due to reduction of the thickness of the magnet.

In order to achieve the object of the invention, according to a first aspect of the present invention, a magnetic circuit for a speaker comprises: a bonded magnet, which is shaped rectangular in top plan view, has on its top face a plurality of grooves formed all the way along two opposing sides thereof and arrayed in parallel with one another at predetermined intervals, and which is magnetized such that magnetic fluxes at two adjacent grooves are directed inversely to each other; and a plurality of plate-like pole pieces, which are fixedly disposed on the top face of the bonded magnet, and which are arrayed in parallel with the grooves such that two adjacent pole pieces form an air gap along the center of each groove thereby forming a magnetic gap.

According to a second aspect of the present invention, in the magnetic circuit of the first aspect, the bonded magnet is fabricated such that a mixture of a magnetic powder containing a rare-earth element and a binder resin is formed into a rectangular shape by a molding method.

According to a third aspect of the present invention, in the magnetic circuit of the first or second aspect, the bonded magnet is magnetized such that a magnetizing coil is wired through the grooves sequentially and a current is caused to flow from one end of the magnetizing coil to the other end so that magnetic fluxes at two adjacent grooves are directed inversely to each other.

According to a fourth aspect of the present invention, a method of manufacturing a magnetic circuit for a speaker comprises the steps of: fabricating a bonded magnet such that a plurality of grooves are formed on the top face of the bonded magnet so as to extend all the way along two opposing sides thereof and to be arrayed in parallel with one another at predetermined intervals; magnetizing the bonded magnet such that a magnetizing coil is wired through the plurality of groves sequentially and a current is caused to flow from one end of the magnetizing coil to the other end so that magnetic fluxes at two adjacent grooves are directed inversely to each other; and fixedly disposing a plurality of plate-like pole pieces such that two adjacent pole pieces form an air gap at a center of each of the grooves thereby forming a magnetic gap.

According to a fifth aspect of the present invention, in the method of the fourth aspect, the bonded magnet is formed by injection-molding.

According to a sixth aspect of the present invention, a speaker comprises: a magnetic circuit, in which a bonded magnet shaped rectangular in top plan view has on its top face a plurality of grooves extending all the way along two opposing sides thereof and arrayed in parallel to one another at predetermined intervals, and is magnetized such that magnetic fluxes at two adjacent grooves are directed inversely to each other, and in which a plurality of plate-like pole pieces are disposed along the grooves formed on the top face of the bonded magnet so that two adjacent pole pieces form an air gap along the center of each groove thereby forming a magnetic gap; and at least one voice coil, which is shaped either rectangular or oval in top plan view, and which has its two opposing straight portions disposed in respective magnetic gaps.

According to a seventh aspect of the present invention, a speaker comprises: a magnetic circuit, in which a bonded magnet shaped rectangular in top plan view has on its top face a plurality of grooves extending all the way along two opposing sides thereof and arrayed in parallel to one another at predetermined intervals, and is magnetized such that magnetic fluxes at two adjacent grooves are directed inversely to each other, and in which a plurality of plate-like pole pieces are disposed on the top face of the bonded magnet along the grooves so that two adjacent pole pieces form an air gap along the center of each groove thereby forming a magnetic gap; at least one voice coil shaped either rectangular or oval in top plan view and having its opposing straight portions disposed in respective magnetic gaps; and a flat diaphragm, which is attached directly to a top end of a voice coil bobbin including the voice coil thereby eliminating a spider.

According to an eighth aspect of the present invention, in the speaker of the sixth or seventh aspect, the thickness of the bonded magnet is minimized, and a number of the voice coil is raised for preventing the decline in sound pressure due to reduction of the thickness of the bonded magnet.

In the magnetic circuit for a speaker according to the present invention, the structure of a magnetic circuit is very simple thereby making the manufacture easier, and a pot yoke is not required therefore readily reducing its thickness. If the magnetic circuit retains its total thickness, the volume of a magnet can be increased to raise the sound pressure, because the pot yoke previously required is now eliminated.

Further, since a plurality of voice coils can be driven by one magnet, a decrease in sound pressure due to reduced thickness of the magnet can be averted.

In the method of manufacturing a magnetic circuit according to the present invention, the magnetic circuit can be made very easily thereby realizing a significant cost reduction.

In the speaker according to the present invention, which employs the above described magnetic circuit, the thickness can be reduced without suffering a decrease in sound pressure.

BRIEF DESCRIPTION OF THE DRAWINGS

The above objects and other advantages of the present invention will become more apparent by describing in detail the preferred embodiments of the present invention with reference to the attached drawings, in which.

DETAILED DESCRIPTION OF THE PREFERRED EMBODIMENTS

Preferred embodiments of the present invention will be described with reference to the accompanying drawings.

Figure 1:
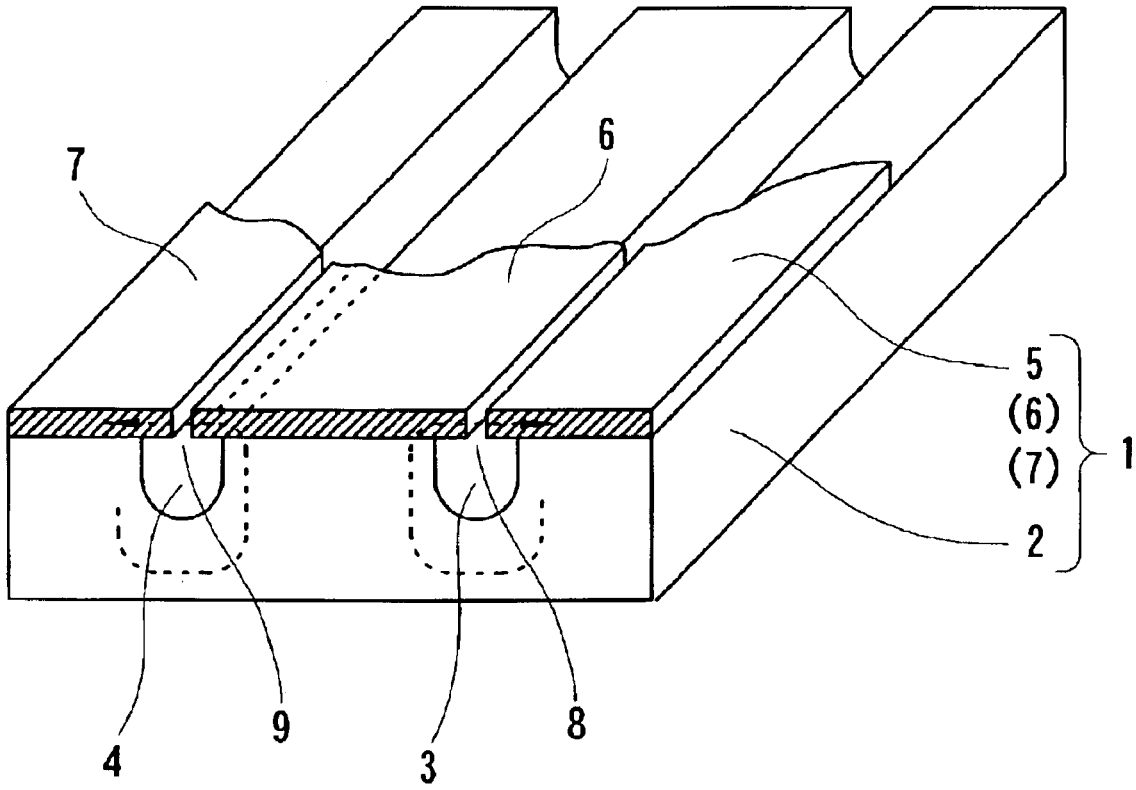
FIG. 1 is a partly cutaway perspective view of a magnetic circuit for a speaker according to an embodiment of the present invention.

Referring to FIG. 1, a magnetic circuit 1 comprises: a bonded magnet 2 shaped rectangular and having a prescribed thickness; and a plurality (three in this embodiment) of plate-like pole pieces 5, 6, 7 fixedly disposed on the top face of the bonded magnet 2 and forming magnetic gaps 8, 9. Here, the "rectangular" for the bonded magnet 2 includes "square".

The bonded magnet 2 is fabricated such that magnetic powder containing, as its major component, a rare-earth element typified by neodymium, iron and boron is bound by a binder resin, such as: a polyamide resin, e.g. nylon 6 and nylon 12; polystyrene resin; PET (polyethylene terephthalate), PBT (polybutylene terephthalate), polyolefin resin, e.g. polyethylene; or denatured polyolefin resin, and is injection-molded into a rectangular shape with a predetermined thickness.

The rare-earth element is not specifically defined but may be Sm—Co alloy, Nd—Fe—B alloy, or Ce—Co alloy, and its content ratio in the alloy is 50 to 98%, preferably 80 to 98%. And the amount thereof is appropriately determined in accordance with the required intensity of magnetic poles, and generally 60 to 90 weight % of an entire bonded magnet.

The bonded magnet 2 has, on its top face, a plurality (two in this embodiment) of grooves 3, 4, which are shaped in U-letter in cross-section, extend all the way through and in parallel to the longer sides of the magnet 2 (unless square) with a predetermined distance therebetween. The grooves 3, 4 may be separately formed after the bonded magnet 2 is molded, but preferably is simultaneously formed when the bonded magnet 2 is injection-molded.

Figure 2:
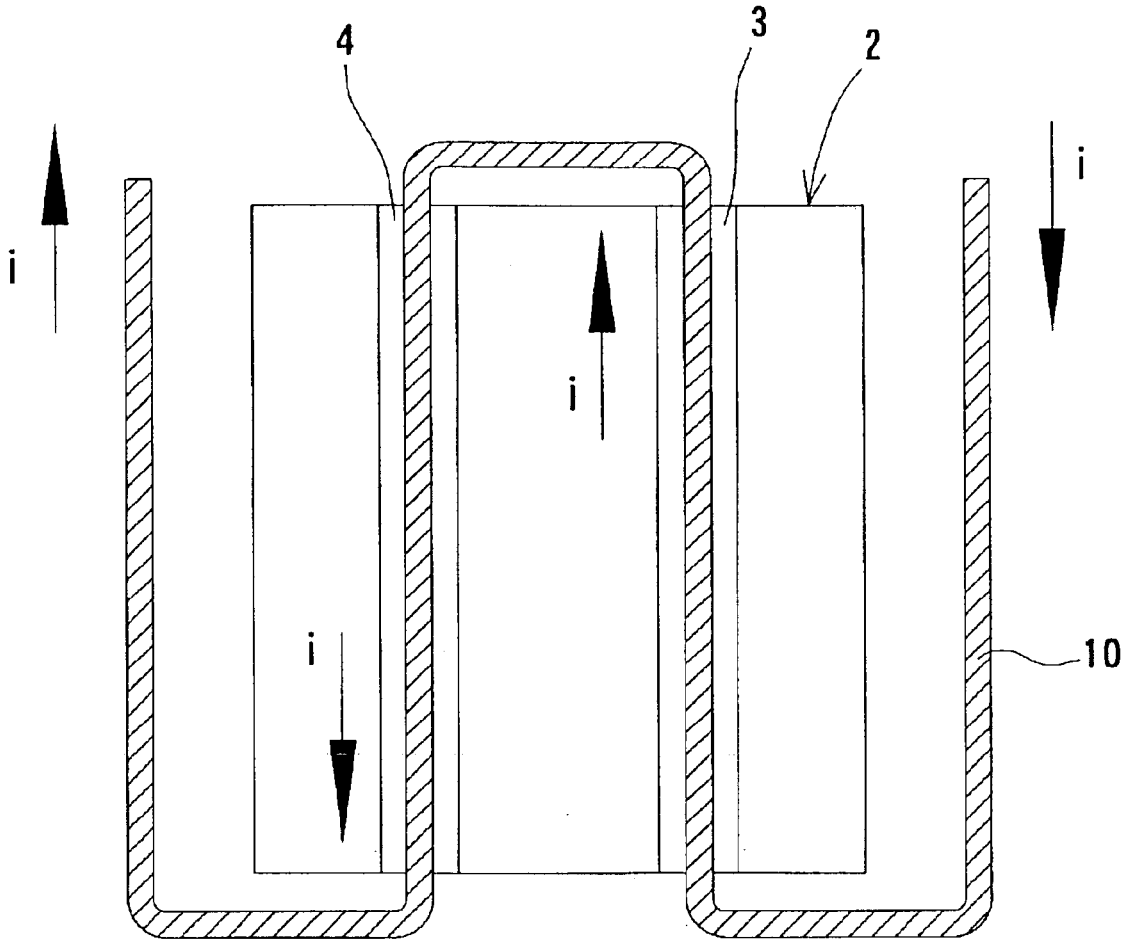
FIG. 2 is a view showing a method of magnetization.
Figure 3:
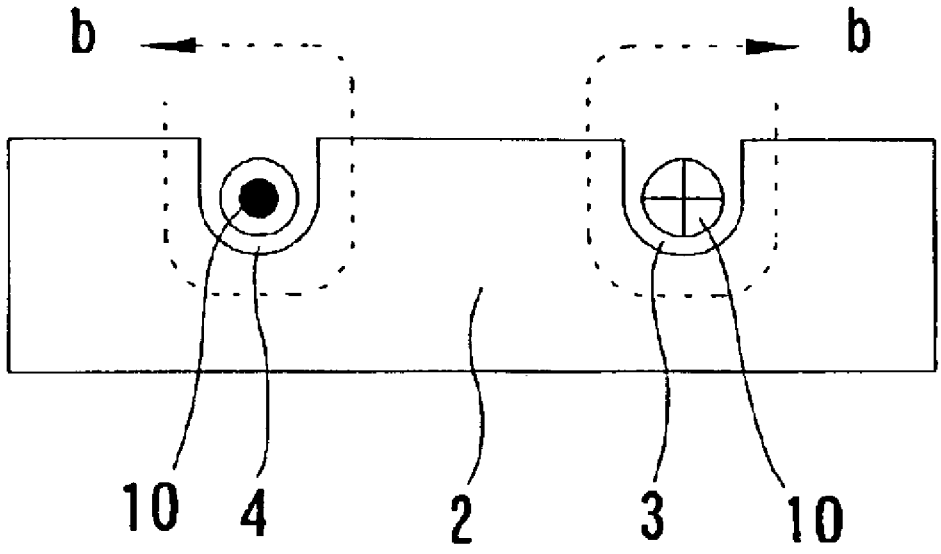
FIG. 3 is a side view of FIG. 2.

Referring to FIG. 2, a magnetizing coil 10 is wired through the groove 3, then through the groove 4. When a DC current i is applied to the magnetizing coil 10, the bonded magnet 2 is magnetized with its flux directed clockwise at the groove 3 and counterclockwise at the groove 4, as shown in FIG. 3.

The bonded magnet 2 is magnetized using a magnetization power unit (not shown), which comprises a charge control circuit, a capacitor, and a discharge circuit. An AC voltage is controlled by the charge control circuit, stepped up by a transformer, converted into a direct current by a rectifying circuit, and charged in the capacitor. When the electricity charged is turned on by the discharge circuit, a magnetizing coil (corresponding to the above described magnetizing coil 10) is provided with a high current, which generates a high magnetic field required for magnetization.

The bonded magnet 2 shown in FIG. 1 was magnetized using SCB-4030MD (a magnetizing power unit by NIHON DENJI SOKKI Co., Ltd.) with a magnetizing coil of 1.6 mm diameter, under a current of 20,000 A, a voltage of 2,000 V, and a capacitance of 1,000 $\mu$A. If a direct current is caused to flow in the reversed direction, the bonded magnet 2 is magnetized with its flux directed counterclockwise at the groove 3 and clockwise at the groove 4.

Referring back to FIG. 1, the bonded magnet 2 magnetized as above described has, on its top face, the pole piece 5 having a predetermined width to measure from the edge of one longer side of the bonded magnet 2 so as to protrude over the groove 3, the pole piece 6 having a predetermined width different from the width of the pole piece 5 such that both side ends protrude respectively over the grooves 3 and 4, and the pole piece 7 having a predetermined width to measure from the edge of the other longer side of the bonded magnet 2 so as to protrude over the groove 4, wherein an air gap defined by and sandwiched between respective protruding side ends of the pole pieces 5 and 6 is formed along the center of the groove 3, and another air gap defined by and sandwiched between respective protruding side ends of the pole pieces 6 and 7 is formed along the center of the groove 4, whereby magnetic gaps 8 and 9 are formed respectively over the groove 3 and 4 thereby forming the magnetic circuit 1 for a speaker.

Figure 4:
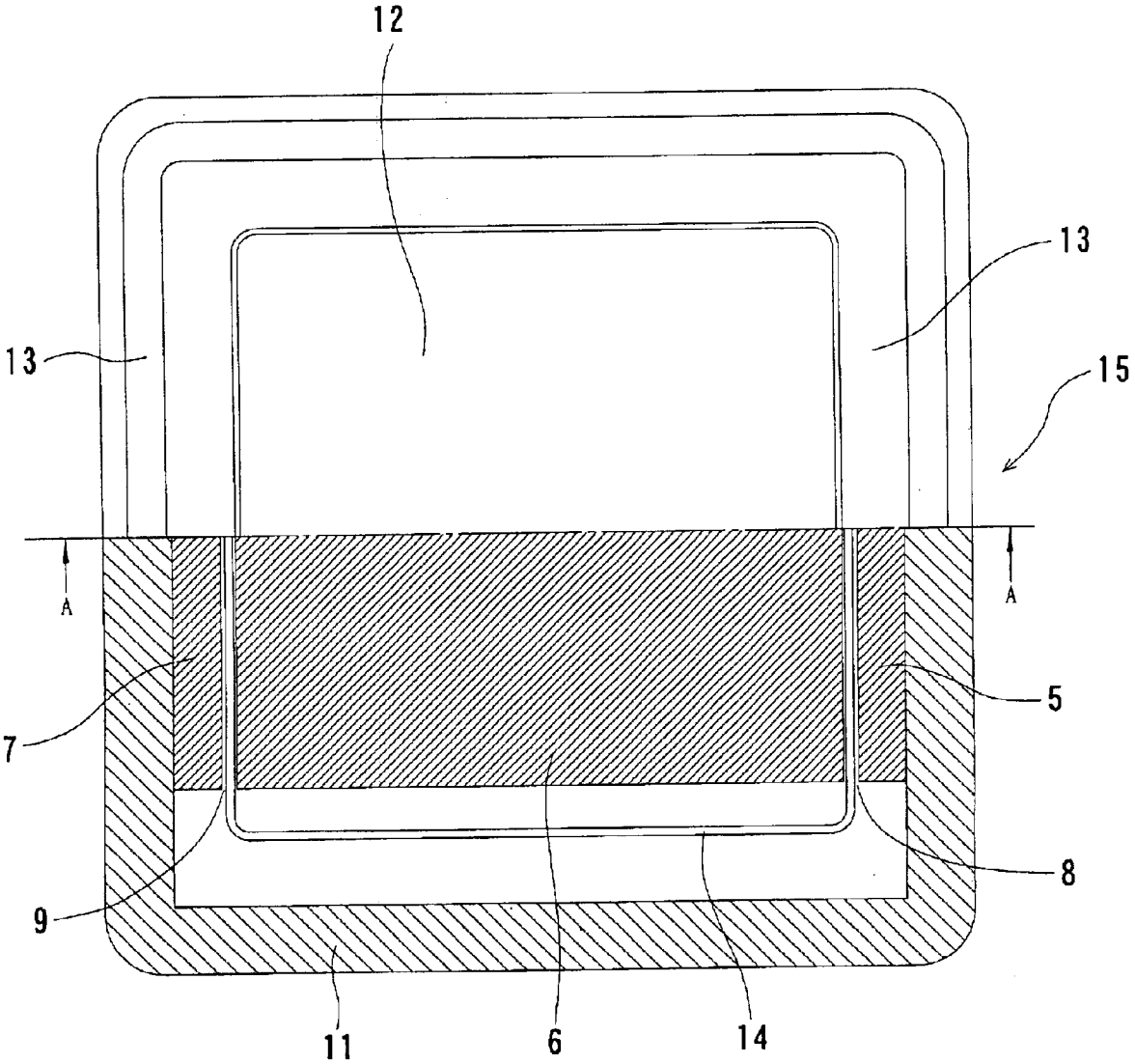
FIG. 4 is a top plan view of a speaker using the magnetic circuit shown in FIG. 1.
Figure 5:
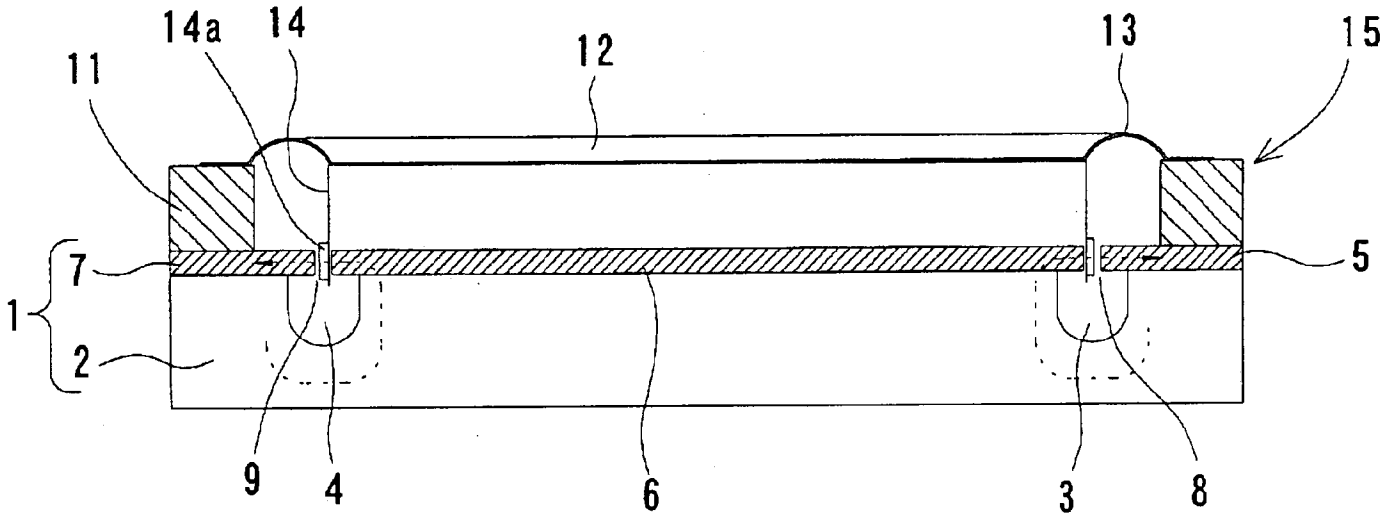
FIG. 5 is a sectional view of the speaker shown in FIG. 4 taken along a line A—A.

Referring to FIGS. 4 and 5, a speaker 15 of the present invention is constituted such t hat a frame 11 shaped rectangular in top plan view is fixedly disposed on the pole pieces 5 and 7 of the magnetic circuit 1 formed as above, a voice coil bobbin 14, which is outlined substantially square in top plan view and includes a voice coil 14*a* wound therearound with its two opposing side portions disposed respectively in the magnetic gaps 8 and 9, has its upper end attached directly to the inner face of a flat diaphragm 12, and that the outer edge of a surround 13 formed continuously at the outer circumference of the diaphragm 12 is fixedly attached to the upper face of the frame 11.

The voice coil bobbin 14 (the voice coil 14*a*) is square in top plan view in the embodiment, but may alternatively be configured such that portions except the two opposing side portions disposed respectively in the magnetic gaps 8 and 9 are gently arced outwardly.

In the speaker 15 of the present invention, its height can be reduced by minimizing the thickness of the frame 11, and also a spider can be eliminated by attaching the voice coil bobbin 14 directly to the diaphragm 12.

Figure 6:
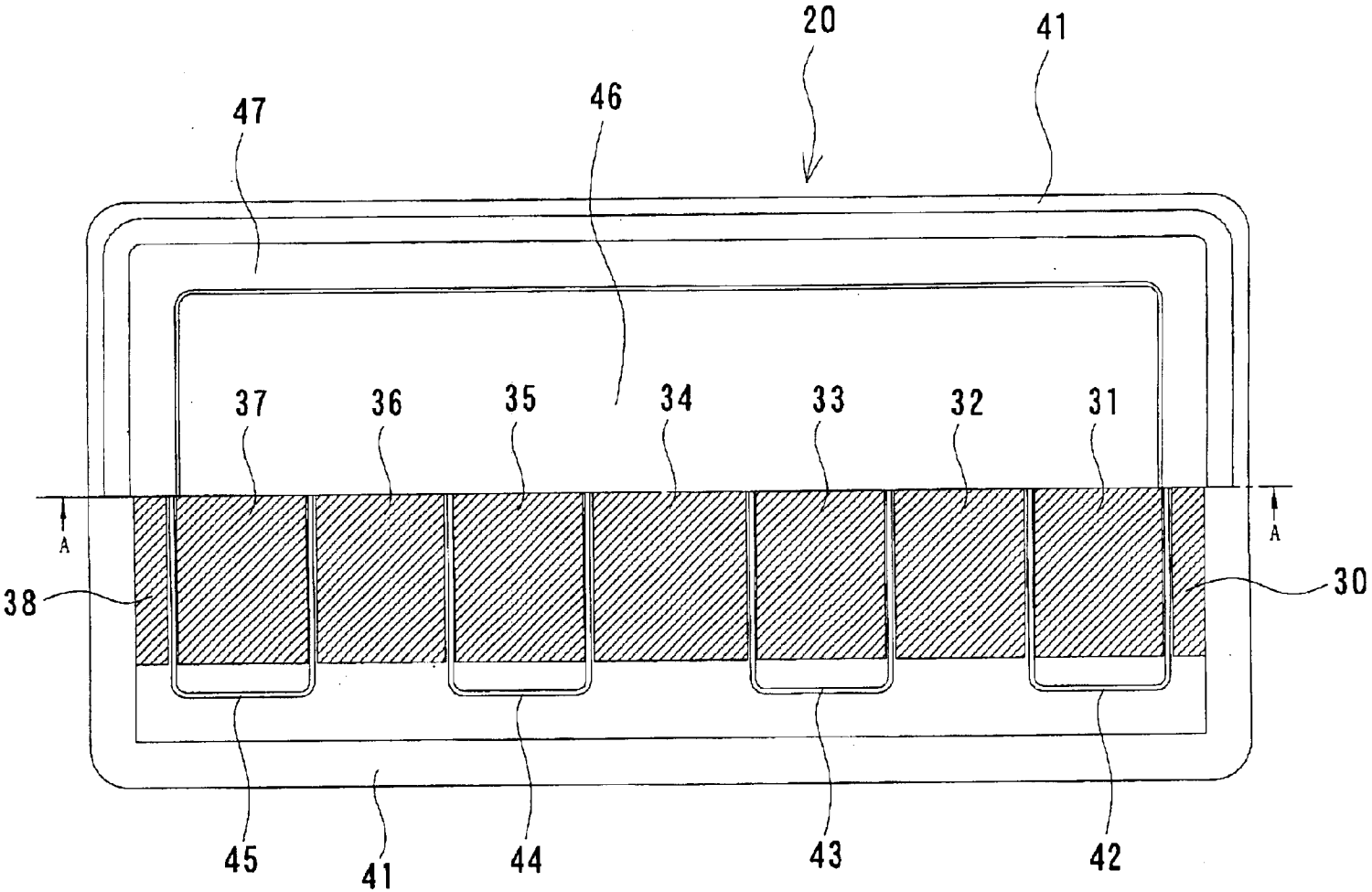
FIG. 6 is a partly cutaway top plan view of a speaker according another embodiment of the present invention.
Figure 7:
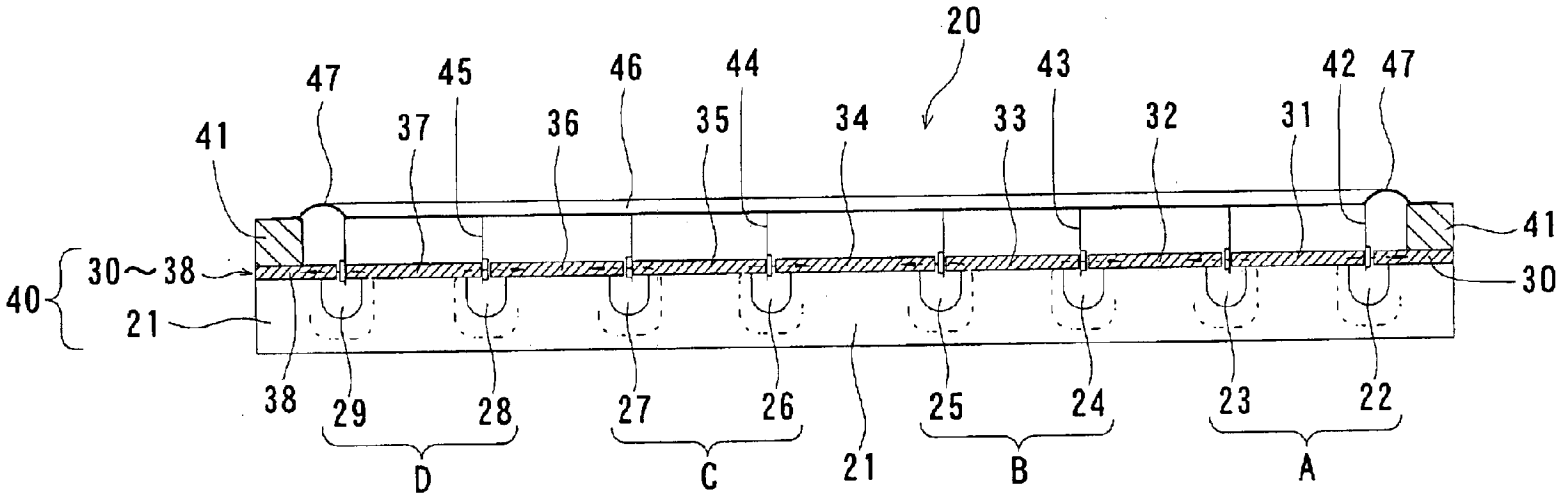
FIG. 7 is a sectional view of the speaker shown in FIG. 6 taken along a line A—A.

FIGS. 6 and 7 show a speaker 20, which is another embodiment of the present invention. The speaker 20 is structured as follows. A rectangular bonded magnet 21 has its longer sides measuring substantially longer than its shorter sides, and has eight grooves 22 to 29 shaped in U-letter in cross-section, extending along the shorter side, and arrayed along the longer sides at predetermined intervals in parallel with one another. The bonded magnet 21 is magnetized by a magnetizing coil which starts from one end of the groove 22, goes through the grooves 22 to 29 sequentially and terminates at one end of the groove 29 so that when a direct current flows in the magnetizing coil, magnetic fluxes at two adjacent grooves are directed inversely to each other in the same way as shown in FIG. 2. Nine pole pieces 30 to 38 are fixedly disposed on the top face of the bonded magnet 21 such that a magnetic gap with a predetermined dimension is formed over the center of each groove between two adjacent pole pieces, thereby constituting a magnetic circuit 40. A frame 41 shaped rectangular with its longer sides measuring substantially longer than its shorter sides is fixed onto the pole pieces 30 and 38 located respectively at both ends of the magnetic circuit 40. Two adjacent grooves 22 and 23, two adjacent grooves 24 and 25, two adjacent grooves 26 and 27, and two adjacent grooves 28 and 29 define units A, B, C and D, respectively, each of which has two straight portions along which two opposing straight portions of each of voice coil bobbins 42, 43, 44 and 45 shaped rectangular in top plan view and each including a voice coil are aligned. And, the top ends of the voice coil bobbins 42, 43, 44 and 45 are attached directly to the inner face of a diaphragm 46, and the outer rim of a surround 46 provided continuously at the outer circumference of the diaphragm 46 is attached to the top face of the frame 40.

In the magnetic circuit 41, in which the bonded magnet 21 has a plurality of grooves formed in parallel with one another and arrayed at predetermine intervals, the bonded magnet 21 can be minimized in its thickness, which may possibly result in a decreased sound pressure, but the diaphragm can be driven by the plurality of voice coils thereby preventing a decline in the sound pressure. Accordingly, a speaker can be achieved, which has a high sound pressure and has a reduced profile as well.

What is claimed is:

1. A magnetic circuit for a speaker, the circuit comprising: a bonded magnet, which is shaped rectangular in top plan view, has on its top face a plurality of grooves formed all the way along two opposing sides thereof and arrayed in parallel with one another at predetermined intervals, and which is magnetized such that magnetic fluxes at two adjacent grooves are directed inversely to each other; and a plurality of plate-shaped pole pieces, which are fixedly disposed on the top face of the bonded magnet, and which are arrayed in parallel with the grooves such that two adjacent pole pieces form an air gap along a center of each groove thereby forming a magnetic gap.

2. A magnetic circuit according to claim 1, wherein the bonded magnet is fabricated such that a mixture of a magnetic powder containing a rare-earth element and a binder resin is formed into a rectangular shape by a molding method.

3. A magnetic circuit according to claim 1 or 2, wherein the bonded magnet is magnetized such that a magnetizing coil is wired through the grooves sequentially and a current is caused to flow from one end of the magnetizing coil to the other end so that magnetic fluxes at two adjacent grooves are directed inversely to each other.

4. A method of manufacturing a magnetic circuit for a speaker, the method comprising the steps of:

fabricating a bonded magnet such that a plurality of grooves are formed on a top face of the bonded magnet so as to extend all the way along two opposing sides thereof and to be arrayed in parallel with one another at predetermined intervals;

magnetizing the bonded magnet such that a magnetizing coil is wired through the plurality of grooves sequentially and a current is caused to flow from one end of the magnetizing coil to the other end so that magnetic fluxes at two adjacent grooves are directed inversely to each other; and fixedly disposing a plurality of plate-shaped pole pieces such that two adjacent pole pieces form an air gap at a center of each of the grooves thereby forming a magnetic gap.

5. A method according to claim 4, wherein the bonded magnet is formed by injection-molding.

6. A speaker comprising: a magnetic circuit, in which a bonded magnet shaped rectangular in top plan view has on its top face a plurality of grooves extending all the way along two opposing sides thereof and arrayed in parallel to one another at predetermined intervals, and is magnetized such that magnetic fluxes at two adjacent grooves are directed adversely to each other, and in which a plurality of plate-shaped pole pieces are disposed along the grooves formed on the top face of the bonded magnet so that two adjacent pole pieces form an air gap along a center of each groove thereby forming a magnetic gap; and at east one voice coil, which is shaped either rectangular or oval in top plan view, and which has its two opposing straight portions disposed in respective magnetic gaps.

7. A speaker comprising: a magnetic circuit, in which a bonded magnet shaped rectangular in top plan view has on its top face a plurality of grooves extending all the way along two opposing sides thereof and arrayed in parallel to one another at predetermined intervals, and is magnetized such that magnetic fluxes at two adjacent grooves are directed adversely to each other, and in which a plurality of plate-shaped pole pieces are disposed along the grooves formed on the top face of the bonded magnet so that two adjacent pole pieces form an air gap along a center of each groove thereby forming a magnetic gap, and at least one voice coil, which is shaped either rectangular or oval in top plan view, and which has its two opposing straight portions disposed in respective magnetic gaps; and a flat diaphragm, which is attached directly to a top end of a voice coil bobbin including the voice coil, whereby a spider is eliminated.

8. A speaker according to claim 6 or 7, wherein the thickness of the bonded magnet is minimized, and a number of voice coils is increased thereby covering a decline in sound pressure due to reduction in the thickness of the bonded magnet.

* * * * *